United States Patent [19]

Hirschfeld

[11] 3,950,875

[45] Apr. 20, 1976

[54] TRIGGER FOR SELECTIVELY DISCHARGING SIMULTANEOUSLY ANY NUMBER OF BARRELS ON A MULTIPLE-BARRELLED FIREARM

[75] Inventor: Michael Hirschfeld, Montevideo, Uruguay

[73] Assignee: Block Engineering, Inc., Cambridge, Mass.

[22] Filed: Jan. 26, 1971

[21] Appl. No.: 109,856

[52] U.S. Cl. ..... 42/42 R; 112/42 B

[51] Int. Cl.[2] ..... F41C 19/00

[58] Field of Search ..... 42/42, 43

[56] References Cited

UNITED STATES PATENTS 3,597,870 8/1971 Block ..... 42/42

*Primary Examiner*—Charles T. Jordan

*Attorney, Agent, or Firm*—Schiller & Pandiscio

[57] ABSTRACT

A firing mechanism for a firearm with a barrel assembly having a plurality of substantially parallel barrels. The mechanism comprises a like plurality of firing assemblies, each assembly being associated with one barrel. The firing assembly is arranged to selectively discharge one or more cartridges. The assembly includes a trigger adapted to engage and release the firing assembly in sequence, and it includes means for adjustably controlling the number of firing assemblies which can be released upon a single actuation of the trigger.

10 Claims, 13 Drawing Figures

INVENTOR
MICHAEL HIRSCHFELD

Schiller & Pandiscia
ATTORNEYS

INVENTOR
MICHAEL HIRSCHFELD

Schiller & Pandiscio
ATTORNEYS

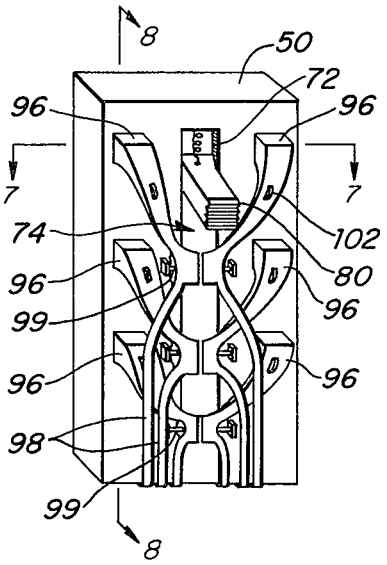
FIG. 6.
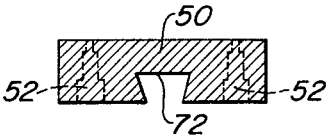
FIG. 7.
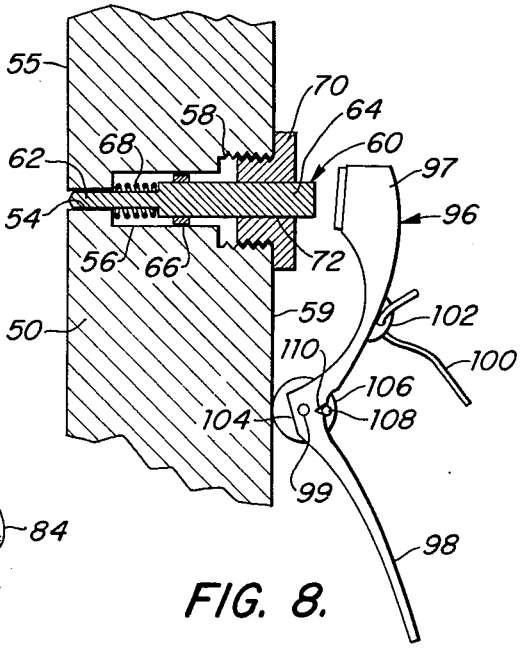
FIG. 8.
FIG. 9.
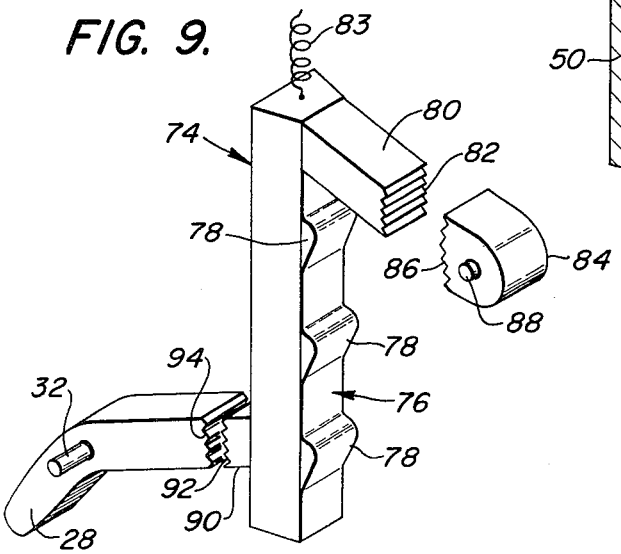
INVENTOR
MICHAEL HIRSCHFELD
Schiller & Pandiscio
ATTORNEYS

INVENTOR
MICHAEL HIRSCHFELD

Schiller & Pandiscio

ATTORNEYS

TRIGGER FOR SELECTIVELY DISCHARGING SIMULTANEOUSLY ANY NUMBER OF BARRELS ON A MULTIPLE-BARRELLED FIREARM

This invention relates to multiple-barrel firearms and more particularly to a hand weapon such as a derringer; specifically a weapon with which a shooter can discharge selected groups of barrels upon a single actuation of the trigger or, alternatively, can discharge each barrel separately by successive actuations of the trigger.

It should be appreciated that under certain conditions, such as an unexpected, close-quarter attack, one may have little time to defend oneself and thus have little opportunity to aim and fire a weapon in defense. Accordingly, the primary object of the present invention is to provide a small, compact hand weapon which is effective at close-quarters with little or no aiming. Another object is to provide in such a weapon the capability of multiple-barrel discharge, and to provide means by which all barrels can be simultaneously readied for rapid discharge.

Another object is to provide a multiple-barrel weapon with which a shooter can discharge groups of barrels upon the single actuation of the trigger or, alternatively, discharge individual barrels upon successive actuations of the trigger. Yet another object is to provide, in a multiple-barrel weapon, the ability to discharge an adjustably-variable number of barrels, simultaneously, in groups of any number up to the total number of barrels in the weapon. Other objects are to provide a small, compact hand weapon capable of firing six bullets simultaneously, or in lesser groups, or individually without re-cocking the weapon, until the weapon has been totally discharged.

The above and other objects are achieved by a weapon including a breech frame which is pivotally connected to a bore piece comprising six substantially parallel barrels and a shell ejector mechanism. The breech frame is comprised of a handle, trigger and trigger mechanism, and also arming and firing mechanisms, the latter including six firing pins and a corresponding number of hammers and hammer springs. The weapon is opened by pivoting the bore piece relative to the breech so that cartridges (e.g. 22 caliber) can be inserted into the corresponding barrels. When the weapon is closed, by pivoting the bore piece into axial alignment with the breech, all six hammers are cocked simultaneously.

Disposed on the outer surface of the weapon is an adjustable indicator coupled to the trigger mechanism. This indicator, when set to any one of six possible positions, arms the firing mechanism so that when the trigger is actuated, the number of barrels discharged corresponds to the position of the indicator. For example, the arming mechanism can be successively set at each position so that one barrel will be discharged upon each following actuation of the trigger. Alternatively, to have a plurality of the barrels simultaneously discharged, the indicator may be positioned so that a group of barrels can be discharged on the next successive actuation of the trigger.

Yet other objects of the present invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description, taken in connection with the accompanying drawings wherein:

FIG. 6 is an enlarged perspective view showing a number of the elements of the firing and cocking mechanism of the weapon of FIG. 1;

FIG. 7 is a sectional view taken through line 7—7 of FIG. 6;

FIG. 8 is an enlarged sectional view showing the firing pin and a fragment of the firing mechanism taken along the line 8—8 of FIG. 6 of the embodiment of FIG. 6;

FIG. 9 is a perspective exploded view showing the arming lever and associated elements of the invention;

Figure 1:
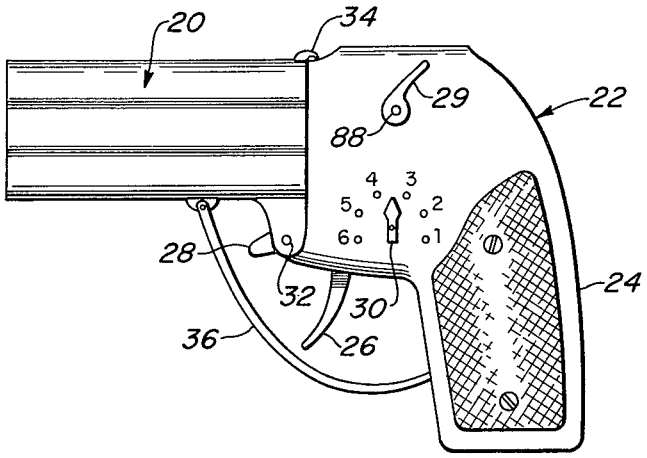
FIG. 1 is a side elevation of a hand weapon constructed according to the present invention.
Figure 2:
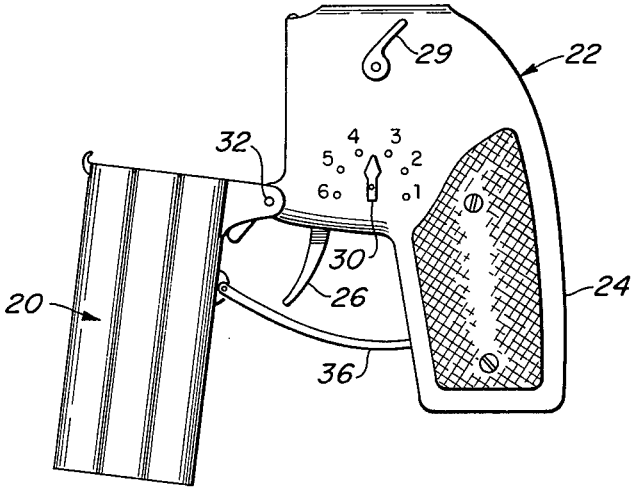
FIG. 2 is a view similar to FIG. 1 but showing the weapon in an open or broken position, ready to receive shells.

Referring now to the drawing, there is shown in FIG. 1 and FIG. 2 the exterior features of the weapon which comprises two major portions, barrel assembly 20 and breech frame assembly 22. The latter includes stock 24, and supports trigger 26, cocking lever 28, thumb safety lever 29, and firing selector lever 30. Barrel assembly 20 is pivotally mounted at one end to frame assembly 22, as by pivot pin 32. Both assemblies are held in operative firing relation by releasable detent means shown, for simplicity, as simple friction snap lock 34. Trigger guard 36 has one end pivotally mounted to a bracket on the under side of the barrel assembly, the other end of the guard being slidably supported in slot 38 (as in FIG. 5) in stock 24. Thus, when the weapon is broken open, as in FIG. 2, the latter end of the guard will slide into the hollow interior of the stock.

Figure 3:
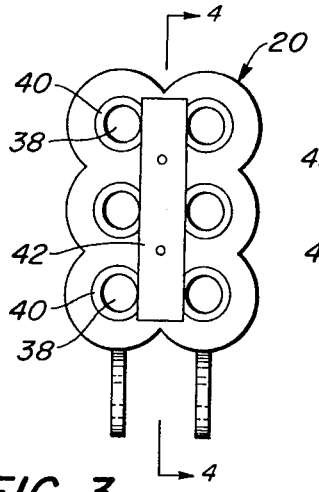
FIG. 3 is an enlarged elevational view showing the barrels and case ejector mechanism.

FIG. 3 shows the breech end of the barrel assembly which comprises a plurality of gun barrels 38, preferably six in number arranged in three tiers of two barrels each, all parallel to one another. The barrels typically, but not necessarily, are of the same caliber. In the description hereinafter, for illustrative purposes, it will be assumed that the weapon is chambered to accept and fire standard, long rifle, caliber .22, rim-fire ammunition.

Figure 4:
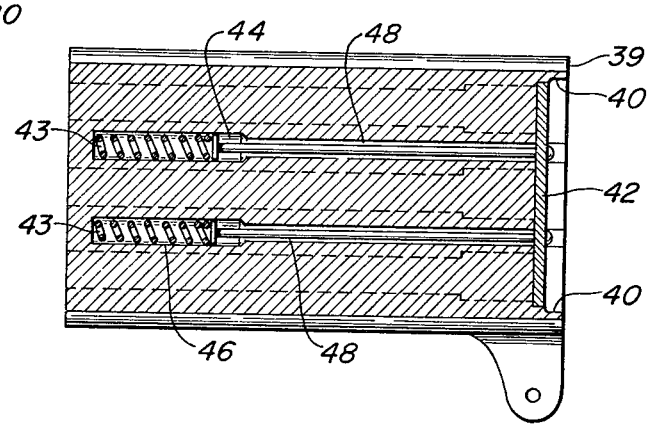
FIG. 4 is a sectional view taken through line 4—4 of FIG. 3.

As shown in broken line in FIG. 4, the bore adjacent breech end 39 of each barrel is slightly over-size to hold the cartridge case. An annular recess or lip 40 is provided for each barrel immediately adjacent breech end 39 to accommodate the rim of the cartridge case. A shell ejector mechanism is included for removing spent cases from the barrels and comprises ejector plate 42 ordinarily nested in a recess in breech end 39 cut so that plate 42, in its nested position, underlies a portion of each lip 40 of each barrel, with a surface of the plate being flush with the surface of each lip. Means are provided for moving plate 42 in a direction normal to its surfaces, and to this end, the barrel assembly includes a pair of blind holes 44 and 46 drilled parallel to the barrels. Disposed in each blind hole is a corresponding pin 48, one end of which is fixed to plate 42. The other end of each pin is against a corresponding compression spring 43. Thus, because the springs serve to bias plate 42 out of its nested position, it will be apparent that if the plate underlies any cartridge case rims, this motion of the plate will tend to remove the spent cases from the barrels.

Figure 5:
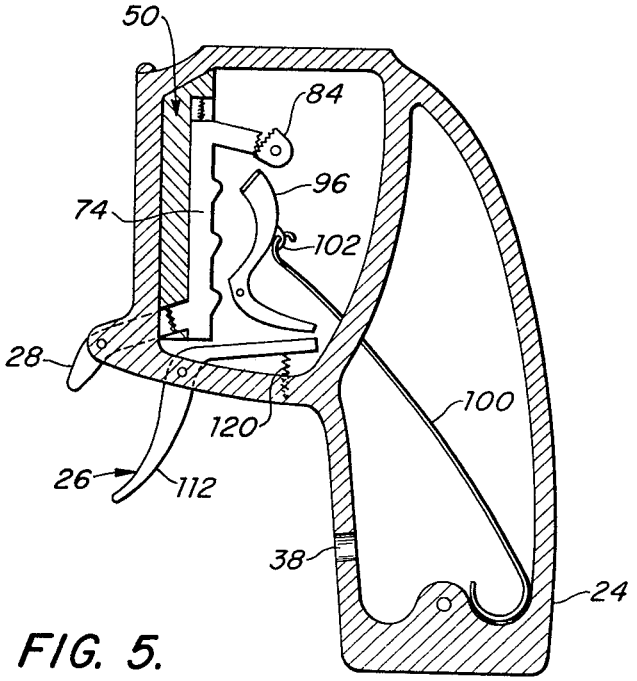
FIG. 5 is a sectional view showing the internal frame of the handle, together with a trigger mechanism and some of the cocking and firing mechanism of the weapon of FIG. 1.
Figure 12:
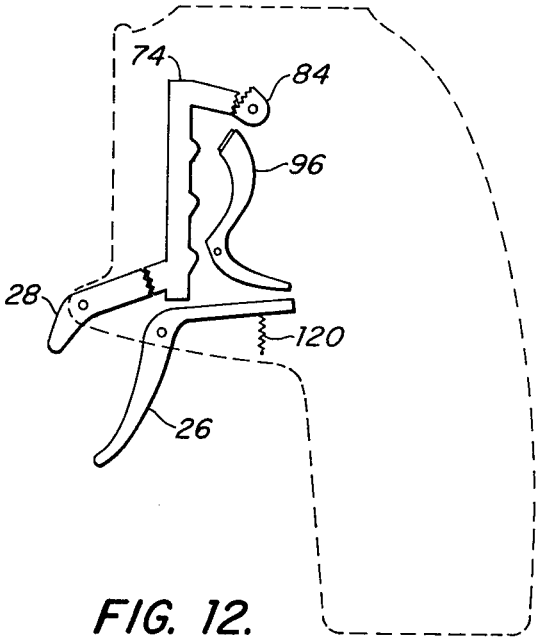
FIG. 12 is a view partly in phantom of selected elements of the mechanism of FIG. 5 showing them in the cocked position.
Figure 13:
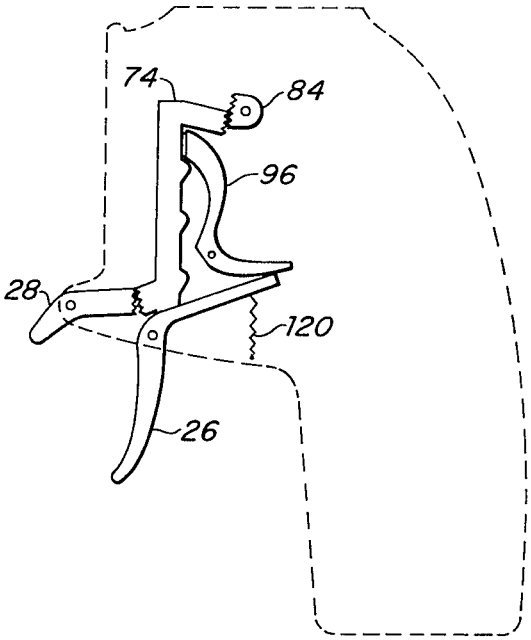
FIG. 13 is a view partly in phantom of selected elements of the embodiment of FIG. 5 in a position at the time of firing.

Mounted on the forward portion of frame assembly 22 is breech block 50 as shown generally in FIG. 5. When the weapon is in the closed position (as in FIG. 1), block 50 closely abuts the breech end of the barrel assembly. The breech block, shown in detail in FIGS. 6–8, includes a plurality of apertures 52 positioned so as to be aligned parallel to the bores of the barrels, each aperture being located so as to be aligned with a portion of a rim of a cartridge in a corresponding bore when the weapon is loaded and closed. As shown in particular in FIG. 8, each aperature is internally stepped so as to define a small cylindrical hole 54 adjacent to front surface 55 of block 50 (intended to abut the barrel assembly); cylindrical hole 56 of somewhat larger diameter; and larger threaded orifice 58 which extends to back surface 59 of the block.

Slidably disposed within each of holes 52 is a corresponding one of firing pins 60. Each pin 60 comprises stem 62 which is sized to be slidable within hole 54, and a body 64 of somewhat larger diameter than the stem. Encircling the body, intermediate its length and secured thereto, is ring 66 which is slightly lesser in diameter than hole 56 and slidable therein. Resilient means, such as coil spring 68, is disposed within hole 56 so as to bias pin 60 away from surface 55. Disposed within and engagable with threaded orifice 58 is hollow screw 70. Hole 72, sized to permit passage of body 64 of pin 60, is formed axially through the center of screw 70. The length of each pin 60 is such that when the weapon is closed, the hammer end of the pin will normally extend under the bias of spring 68 outwardly beyond the head of screw 70, but the stem of the pin (i.e. the striker end) will lie adjacent the rim of a cartridge contained within the corresponding bore.

Vertical dovetail slot 72 is formed (as shown in FIG. 7) in the center of surface 59 of block 50. Dovetail slot 72 extends upwardly from the bottom edge of block 50 substantially between each pair of apertures 52 and terminates approximately adjacent to the top row of the apertures. As shown in FIGS. 6 and 9 particularly, there is provided arming lever 74 slidingly disposed in slot 72. Lever 74 is vertically elongated and is wedge shaped in cross section to lock laterally within slot 72 while being free for longitudinal motion (i.e. up and down). The rear surface of the lever, identified generally at 76 is provided with three vertically spaced, horizontally extending, convex hammer lifters or ridges 78. The distance between each pair of ridges 78 is substantially equal to the vertical spacing between each pair of tiers of holes 52. Also projecting from surface 76 is lever arm 80 which extends downwardly at a slight angle from the top edge of the arming lever. The outward end of arm 80 bears toothed gear surface 82 which lies in a plane substantially parallel to the mean plane of surface 76. Compression spring 83 is connected to the upper end of arming lever 74 and to block 50 so as to bias lever 74 into a normal position away from the top of slot 72.

Referring particularly to FIGS. 5 and 9, there is shown quadrant gear 84 which has a curved, toothed gear surface 86, sized and disposed to mesh with gear surface 82. Gear 84 is pivotally mounted on breech frame 22 by pivot pin 88 disposed across the frame and extending outwardly through the latter. The extension of pin 88 has fixed thereto safety lever 29. Rotation of the latter, either clockwise or counter-clockwise will cause quadrant gear 84 to rotate, and the engagement of surfaces 86 and 82 will thereby move arming lever 74 vertically within dovetail slot 72 either up or down according to the sense of rotation of lever 29.

Referring again to FIG. 9, lever 74 is provided with arm 90 which extends from lever 74 perpendicularly to the long axis of the latter and substantially in the opposite direction to lever arm 80. Arm 90 terminates in a toothed or gear surface 92. The relationship of cocking lever 28 to lever 74 is shown in FIG. 9, cocking lever 28 being rotatably mounted at an intermediate portion thereof upon pivot pin 32. It will be seen that lever 28 is shaped and dimensioned so that the end thereof without gear teeth is engagable with barrel assembly 20 when the weapon is broken open, as shown in FIG. 2; the other end of lever 28 terminates in toothed surface 94 which is engagable with surface 92. Preferably, the teeth of surface 94 vary proportionately in size with the uppermost tooth being the smallest while the lowermost tooth is the largest. The teeth of surface 92, on the other hand, are all substantially uniform in size.

Referring now specifically to FIGS. 5, 6 and 8, there are shown six hammers 96 mounted in an array such that each hammer is positioned to engage the hammer end of a corresponding firing pin 60. Each hammer comprises hammerhead 97 and trip-arm 98, the two portions extending at an angle to one another. The hammers are arranged, as are the firing pins, in tiers, each such tier of hammers being pivotally mounted on surface 59 for rotation independently of one another about a common pivot pin 99 extending through a portion of the hammer intermediate trip arm 98 and hammerhead 97. Thus, there are three pivot pins 99, each pivot pin being secured to the surface of block 50 by an appropriate pair of flanges. Each hammer is individually spring loaded by being coupled to a corresponding compression spring 100 (only one of which is shown as exemplary in FIG. 5). One end of spring 100 is connected to hammerhead 97 as at flange 102, the other end of spring 100 extending into contact with an interior portion of stock 24. It will be seen from FIG. 6 that regardless of the particular location of each pair of hammers, the trip-arms of the hammers are dimensioned so that all six trip-arms terminate substantially along a common line. To effect this, one pair of hammers has relatively short trip-arms, another pair relatively long trip arms, and a third, lying intermediate the first two pairs in location, have trip arms of relatively intermediate length.

As shown particularly in FIG. 8, each hammer, adjacent pivot pin 99, is provided with a relatively flat cam surface 104, facing surface 59. These surfaces 104 are shaped and dimensioned to engage corresponding ridges 78 of arming lever 74 as will be described hereinafter.

Preferably, each pin 99 is fixed so that it will not rotate about its long axis. Fixed to each pin, and lying immediately adjacent a corresponding hammer 96 is a respective flat locking disc 106. Each disc includes a protruding locking catch 108 which extends into the path of rotation of the hammer about pin 99. Each hammer is therefore provided with a notch 110 positioned to engage locking catch 108 when the hammer is in its cocked position. Other types of sears may of course be employed.

Figure 10:
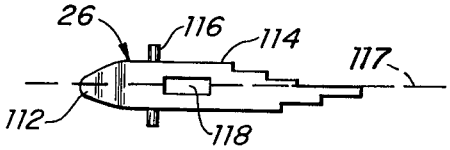
FIG. 10 is a plan view of the trigger of the weapon.

Lastly, as shown particularly in FIG. 10, trigger 26 includes a manually engagable portion 112 which is intended to extend out of the frame assembly 22, and a substantially flattened trip portion 114 connected at an angle to portion 112. Trigger 26 is mounted within assembly 22 by pivot pin 116 which extends through the trigger at a position near the junction of portions 112 and 114. The trigger is shaped so that when it is pivoted above pin 116, portion 114 rotates substantially perpendicularly to its plane. Portion 114 is provided on one side of its centerline 117 with two notches each of which defines an edge spaced a different length from pivot pin 116 the back end of portion 114 being considered one of these notches, the end of portion 114 opposite pin 116 defining a third such edge. Similarly, the other side of the centerline of portion 114 is provided with three other notches each of which defines an edge spaced a different distance from pivot 116, no two notches being the same distance from the pivot pin. Trigger 26 and breech block 50 are so disposed that each of the edges defined by the back end and by the notches in portion 114 of trigger 26 will engage a corresponding trip-arm of a respective hammer 96 at a unique rotational position of the trigger about pin 116. Portion 114 is also provided with a central aperture 118 positioned so that the lower end of arming lever 74 may slide therethrough. Trigger 26 is biased by spring 120 into a normal position from whence it may be manually rotated to contact the trip arms.

Figure 11:
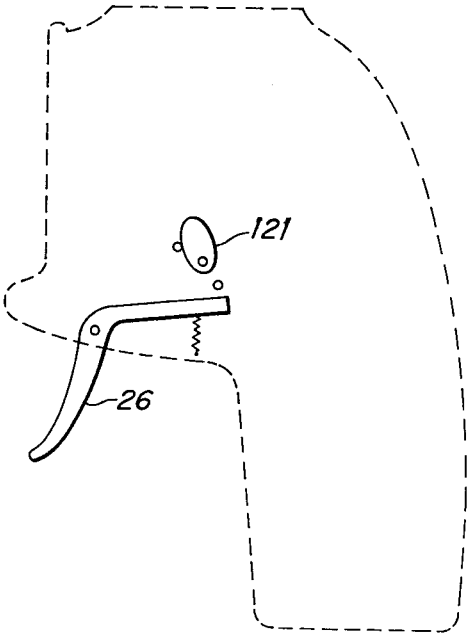
FIG. 11 is a view partly in phantom showing the relation of the trigger and trigger selector mechanism of the weapon.

As shown in phantom in FIG. 11, firing selector lever 30 is pivotally coupled to eccentric cam 121, the latter being positioned within assembly 22 so that its surface provides a limit stop to the rotation of trigger 26. Thus, rotation of lever 30 rotates cam 121, the angular position of the lever and the shape of the cam being calibrated so that, for example, at position "three" the rotation of trigger 26 is limited to that which would permit actuation by the trigger of only three hammers. Thus, the firing selector lever and cam 121 are arranged so that there are six discrete positions of the lever, at each of which positions, maximum rotation of the trigger is limited to the tripping of successively one, two, three etc. hammers. Each position is appropriately identified by some visual indicia such as a numeral.

Assuming that one commences operation by breaking open the weapon by releasing catch 34 and pivoting the barrel about pivot 32, this releases any restraint that may have held plate 42 in its nested position. Springs 43, therefore, impel pins 48 to force plate 42 out of its nested position. Any cartridge cases, the rims of which are engaged by plate 42, will therefore be forced from their respective barrels and can readily be removed. The barrels can then be reloaded and the weapon again closed.

The opening of the weapon causes barrel assembly 20 to engage cocking lever 28. The consequent rotation of the latter causes gear teeth 94 to engage gear teeth 92, raising arming lever 74 in an upward direction against the force provided by spring 83. This upward motion of arming lever 74 causes each ridge 78 to engage a respective tier of cam surfaces 104 of the hammers, causing the hammers to rotate so that the hammer heads are forced away from the firing pins and compressing the respective springs 100. The rotation of the hammers is sufficient to cause each locking catch 108 to engage frictionally the corresponding notch 110. When the weapon is closed, releasing the restraint on cocking lever 28 so that the latter may again rotate, spring 83 can return the arming lever to its normal downward position, releasing ridges 78 from their engagement with cam surface 104. However, the hammers will remain in their cocked position by virtue of the frictional engagement of the respective catches 108 with notches 110. The closure of the weapon also brings the cartridge cases in contact with front surface 55 of block 50. This serves to force the cases to a snug fit within lip 40 of each respective barrel and also to force ejector plate 42 back into its nested position by compression of springs 43.

The weapon is now ready to fire. If one wishes to prevent firing of the weapon, rotation of safety lever 29 causes gear quadrant 84 to rotate and the engagement of gear teeth 86 and 82 will again lift the arming lever against the bias of compression spring 83 into a position wherein the ridges 78 are again in engagement with cam surfaces 104. Under these circumstances, even if the respective catches 108 were disengaged from notches 110, the hammers would be unable to rotate and cause the hammerheads to strike the firing pins.

If one wishes to fire merely a single barrel, the selector lever 30 is set at the "one" position and the trigger pulled. The rotation of the trigger is, in this case, restrained so that only one of the trip levers 98 can be engaged. The pressure of trip portion 114 of trigger 112 against the selected trip lever 98 overcomes the frictional force holding the locking catch and notch together, causing them to disengage and permitting the hammer to rotate under the bias of spring 100 to strike the corresponding firing pin 60. When pin 60 is struck, the forward end of the pin is driven into the rear of the cartridge case, causing the primer in the latter to explode. Obviously, one can select up to six barrels for firing by appropriate disposition of the selector lever. For example, if one sets the selector lever at position "six," the rotation of the trigger will cause the six trip levers to be actuated in sequence. Inasmuch as the angular motion required for the trigger to successively release trip levers may be extremely small, the sequential release of the six will appear as substantially simultaneous. On the other hand, if one wishes to fire the weapon as a single shot device only, the selector lever can be set at successive positions, a single shot being fired each time following the reset of the selector lever. If one dimensions the weapon so that a substantial amount of trigger rotation is required between successive shots, it will be apparent that by delicate rotation of the trigger, only through that limited amount required, one can successively fire spaced single shots simply by setting the lever also at a multiple position, or fire "simultaneous" shots by quickly rotating the trigger through its permissable arc.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a firearm comprising a barrel assembly, a breech frame assembly and connecting means for pivotally coupling said two assemblies so that when said firearm is opened by pivoting the barrel assembly apart from the breech frame assembly, cartridges can be loaded into said barrel assembly and removed therefrom, and when the firearm is closed by pivoting the barrel assembly into alignment with the breech frame assembly, the firearm can be discharged, and wherein said barrel assembly includes a plurality of substantially parallel barrels for containing a like number of cartridges; and wherein said breech frame assembly has a firing mechanism including a like plurality of firing assemblies, each assembly being associated with a respective one of said barrels when said firearm is closed, for selectively causing discharge of the cartridge contained in said respective barrel when the respective firing assembly is actuated;

a trigger mechanism mounted for rotation about a pivot point, said mechanism comprising a manually-engageable trigger and discharge means for engaging and releasing said firing assemblies in sequence upon rotation of said trigger; and indicating means for adjustably controlling the extent of rotation of said trigger mechanism so that upon a single actuation of said trigger, a predetermined number of said firing assemblies can be released so as to discharge a corresponding number of cartridges.

2. The firearm as defined in claim 1 including arming means operative for arming said firing assemblies when said barrel assembly is pivoted from the open to the closed position.

3. The firearm as defined in claim 1 including means for removing said cartridges from said barrels as said firearm is opened.

4. The firearm as defined in claim 3 wherein each of said barrels has an annular bore at the inner end thereof sized to contain a cartridge and an annular recess to accommodate the rim of said cartridge; and wherein said means for removing cartridges comprises an ejector mechanism including an ejector plate nested in the inner end of said barrel assembly so as to underlie said recesses, and resilient means for moving said plate in a direction normal to said barrels so as to engage the rims of said cartridges and force the cartridges from said barrels when the firearm is opened.

5. The firearm as defined in claim 1 wherein each of said barrels has an annular bore at the inner end thereof sized to contain a cartridge, and an annular recess to accommodate the rim of said cartridge, and wherein said firing mechanism also includes a breech block mounted within the inner end of said breech frame assembly with the inner surface thereof adjacent the breech end of said barrel assembly when said firearm is closed, said breech block having a like plurality of apertures arranged to be aligned with the corresponding annular recess of a respective barrel when the firearm is closed;

a like plurality of elongated firing pins slidably disposed within respective ones of said apertures, each pin having a hammer end and a striking end, the latter being disposed adjacent a corresponding annular recess when said firearm is closed; and resilient means for normally biasing said pins away from said annular recess when the firearm is closed.

6. The firearm as defined in claim 5 wherein said firing assemblies comprise:

a like plurality of hammers, means for rotatably coupling said hammers to the outer surface of said breech block, each hammer comprising a hammer head coupled to a trip arm, and each being coupled to said breech block about a pivot point intermediate said hammer head and trip arm, the hammer head of each hammer being rotatably aligned with the hammer end of a respective firing pin with the length of said trip arms being such that the ends thereof terminate in a common plane substantially normal to the axis of elongation of said pins;

resilient means coupled to said hammers for releasably biasing said hammer heads away from said firing pins when said hammers are in a cocked position.

7. The firearm as defined in claim 6 wherein said breech block has a vertical dovetail slot in the outer face thereof opposite said barrels and wherein said arming means comprises:

an arming lever slidably disposed within said slot, said lever having spaced hammer lifters on the outer face thereof for releasably engaging with said hammers;

a first lever arm connected to the bottom edge of said arming lever extending toward said barrel assembly and having a toothed lever upward in said slot so that said hammer lifters contact said hammers to move said hammers into a cocked position.

8. The firearm as defined in claim 7 also including a safety device comprising a second lever arm connected to the top edge of said arming lever extending away from said inner end of said breech frame assembly and having a toothed gear surface at the outer end thereof;

a quadrant gear and means for rotatably mounting said gear within said breech frame assembly, said quadrant gear having a toothed gear surface disposed to mesh with said toothed gear surface of said second lever arm;

a safety lever and means for rotatably mounting said safety lever to the outside of said breech frame assembly so as to be manually engagable, said safety lever being coupled to said quadrant gear so that when rotated will cause said gear to engage with the arming lever and force the arming lever upward in the dovetail slot into a position whereby said hammer lifters engage said hammers to prevent rotation thereof.

9. A firearm as defined in claim 1 wherein said firing assemblies include a like plurality of hammers each connected to a trip arm, said means for releasing said firing assemblies includes a flattened trip member connected to said trigger, said trip member having a plurality of notches defining notch surfaces each of which is spaced a different distance from said pivot point, each notch surface being disposed so as to be engagable with the corresponding trip arm of a respective hammer, and resilient means normally biasing said trip member away from said trip arms; and wherein said indicating means for controlling said trigger mechanism comprises a manually-adjustable indicator, and means for mounting said indicator to the outer surface of said breech frame assembly so that said indicator can be manually positioned to any of a like plurality of possible positions; a cam, and means for coupling said cam to said adjustable indicator, said cam being positioned so that the surface thereof provides a limit stop for rotational movement of said trip member so that when said trigger is rotated, the distance through which the trip member can rotate and the number of hammers released from the cocked position corresponds to the position of the indicator.

10. Firearms as defined in claim 1 wherein said plurality of barrels is arranged in a number of tiers of barrel pairs.

* * * * *